US012061000B2

(12) United States Patent
Farrel

(10) Patent No.: US 12,061,000 B2
(45) Date of Patent: Aug. 13, 2024

(54) DOOR ASSEMBLY OF AN APPLIANCE HAVING ONE OR MORE ASSEMBLY AIDS

(71) Applicant: Haier US Appliance Solutions, Inc., Wilmington, DE (US)

(72) Inventor: Caleb Farrel, Jeffersonville, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 273 days.

(21) Appl. No.: 17/181,046

(22) Filed: Feb. 22, 2021

(65) Prior Publication Data

US 2022/0268447 A1 Aug. 25, 2022

(51) Int. Cl.
*F24C 15/02* (2006.01)
*F24C 15/04* (2006.01)

(52) U.S. Cl.
CPC ..... *F24C 15/023* (2013.01); *F24C 15/04* (2013.01)

(58) Field of Classification Search
CPC ..... F24C 15/023
See application file for complete search history.

(56) References Cited

U.S. PATENT DOCUMENTS 3,155,088 A 11/1964 Roy
2007/0159034 A1* 7/2007 Funcken ..... D06F 39/12 312/257.1
2011/0061308 A1* 3/2011 Badger ..... E06B 3/827 49/501
2019/0063130 A1* 2/2019 Oh ..... F24C 15/023

FOREIGN PATENT DOCUMENTS

EP 1648203 B1 9/2018

* cited by examiner

*Primary Examiner* — Jason Lau
(74) *Attorney, Agent, or Firm* — Dority & Manning, P.A.

(57) ABSTRACT

A door assembly for an appliance includes an outer panel, at least one inner panel arranged adjacent to the outer panel, and a hinge assembly for rotatably securing the door assembly to the appliance. The inner panel(s) includes a first set of apertures. The first set of apertures includes a first aperture and a second aperture. The hinge assembly is secured between the outer and inner panels. The hinge assembly includes a hinge body and a hinge extending from the hinge body. The hinge body defines at least one locating feature and at least one retaining feature formed integrally therewith. The locating feature(s) is received within the first aperture so as to position the inner panel in a desired configuration. The retaining feature(s) is received within the second aperture so as to retain the inner panel in the desired configuration. Further, the door assembly includes one or more fasteners securing the outer panel, the inner panel, and the hinge body together.

13 Claims, 6 Drawing Sheets

DOOR ASSEMBLY OF AN APPLIANCE HAVING ONE OR MORE ASSEMBLY AIDS

FIELD OF THE INVENTION

The present subject matter relates generally to oven appliances and more particularly to assembly aids, such as hinge locators, for a door of an oven appliance.

BACKGROUND OF THE INVENTION

Oven appliances generally include a cabinet with a cooking chamber positioned therein. The cooking chamber is configured for receipt of food articles for cooking. The oven appliance also includes a heating element for generating heat energy for cooking. The heating element can be, e.g., an electric resistance element or a gas burner. Certain oven appliances also include features for forcing movement of heated air within the cooking chamber. Such oven appliances are generally referred to as convection ovens.

In addition, the cooking chamber is selectively accessible via an oven door that rotates about an axis between a closed position and an open position. In certain instances, the door may be rotatable about the axis via a hinge mounted to the door. In such oven appliances, the door-mounted hinges and front frame receivers are aligned and assembled using only screws. This process introduces many variations into the assembly process, e.g., when trying to control appearance gaps, part alignment for assembly, etc. Further, by only using screws to secure the door in place, an installer is required to either hold/support the hinge or receiver while also installing the screws or the installer must have a fixture which supports the door during installation. Depending on the set up, such requirements can be difficult to use and/or can create ergonomic concerns.

Other oven appliances may include a cavity-mounted hinge, however, not all structures can support this style of hinge. Still another solution includes the use of a smaller side post to support the hinge, which can be easier to assemble due to dealing with smaller components.

Accordingly, an oven appliance having certain assembly aids, such as hinge locators, for use during assembly of the door onto the oven appliance would be welcomed in the art.

BRIEF DESCRIPTION OF THE INVENTION

Aspects and advantages of the invention will be set forth in part in the following description, or may be obvious from the description, or may be learned through practice of the invention.

In one aspect, the present disclosure is directed to a door assembly for an appliance. The door assembly includes an outer panel, at least one inner panel arranged adjacent to the outer panel, and a hinge assembly for rotatably securing the door assembly to the appliance. The inner panel(s) includes a first set of apertures. The first set of apertures includes a first aperture and a second aperture. The hinge assembly is secured between the outer and inner panels. The hinge assembly includes a hinge body and a hinge extending from the hinge body. The hinge body defines at least one locating feature and at least one retaining feature formed integrally therewith. The locating feature(s) is received within the first aperture so as to position the inner panel in a desired configuration. The retaining feature(s) is received within the second aperture so as to retain the inner panel in the desired configuration. Further, the door assembly includes one or more fasteners securing the outer panel, the inner panel, and the hinge body together.

In another aspect, the present disclosure is directed to a method of assembling a door assembly of an oven appliance. The method includes providing an outer panel of the door assembly. Further, the method includes placing a hinge assembly adjacent to the outer panel. The hinge assembly includes a hinge body and a hinge extending from the hinge body. The hinge body defines at least one locating feature and at least one retaining feature formed integrally therewith. Moreover, the method includes arranging at least one inner panel adjacent to the outer panel and the hinge assembly such that the at least one retaining feature is secured to the at least one inner panel through a first aperture in the at least one inner panel. The method also includes sliding the at least one inner panel into place until the at least one locating feature engages with a second aperture in the at least one inner panel so as to support the hinge assembly. Further, the method includes securing the door assembly together via one or more fasteners secured through the outer panel, the inner panel, and the hinge body.

These and other features, aspects and advantages of the present invention will become better understood with reference to the following description and appended claims. The accompanying drawings, which are incorporated in and constitute a part of this specification, illustrate exemplary embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
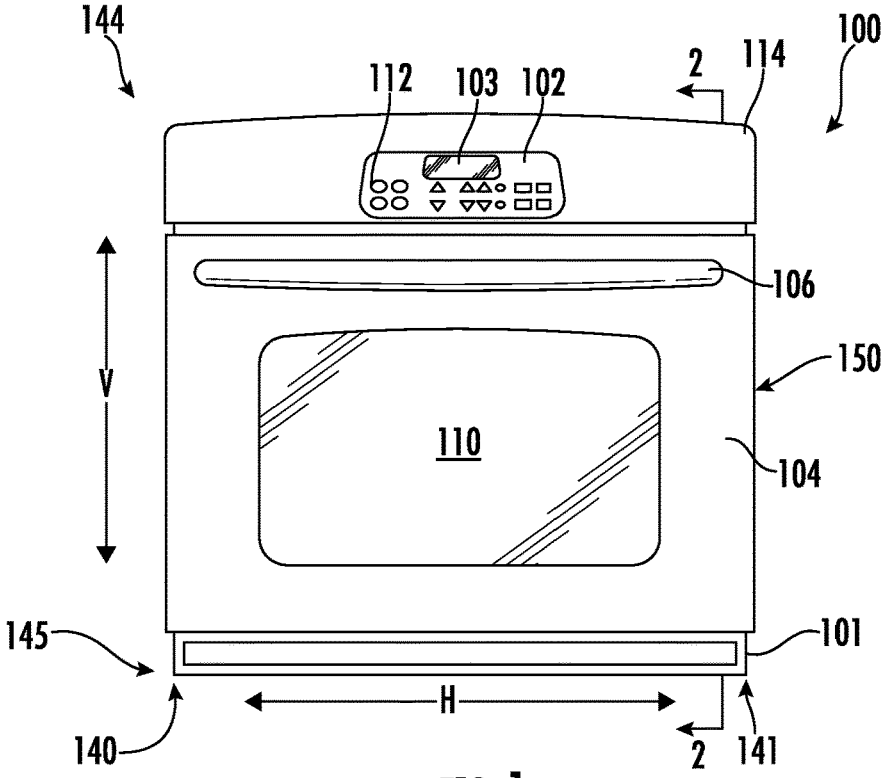
FIG. 1 provides a front view of an oven appliance according to an exemplary embodiment of the present subject matter.

Reference now will be made in detail to exemplary embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
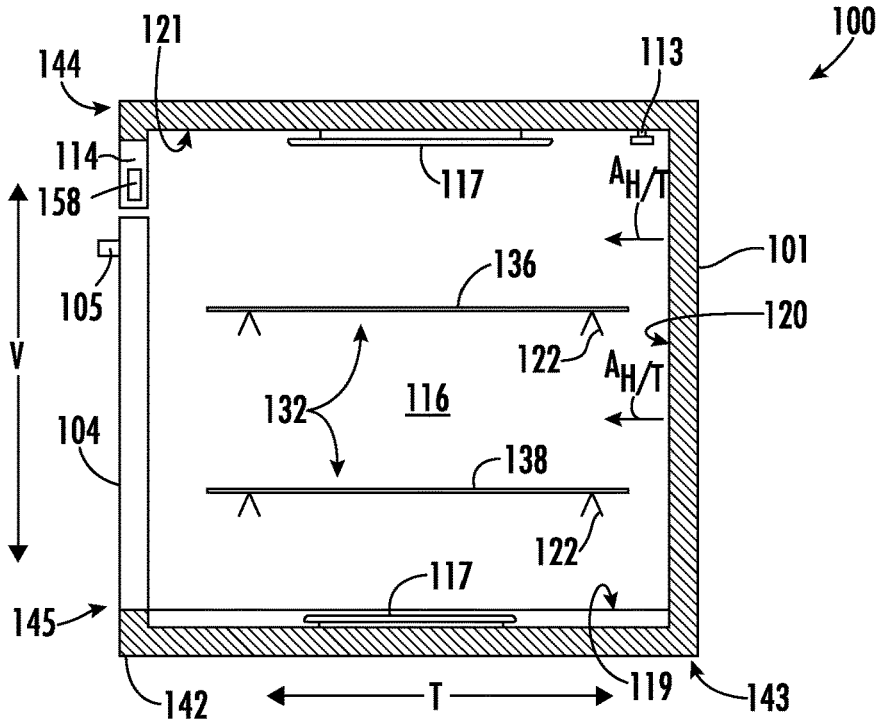
FIG. 2 provides a cross-sectional view of the oven appliance taken along the 2-2 axis of FIG. 1.

Referring to FIGS. 1 and 2, an exemplary embodiment of an oven appliance 100 for providing convection and microwave heating is shown according to the present disclosure. In particular, FIG. 1 provides a front view of the oven appliance 100. FIG. 2 provides a cross-sectional view of the oven appliance 100 taken along the 2-2 axis shown in FIG. 1. The oven appliance 100 includes a cabinet or housing 101 with a cooking chamber 116 positioned therein.

The cabinet 101 extends between a first side 140 (FIG. 1) and a second side 141 (FIG. 1) along a horizontal direction H. Further, the cabinet 101 also extends between a front 142 (FIG. 2) and a back 143 (FIG. 2) along a transverse direction T. The cabinet 101 further extends between a top 144 and a bottom 145 along a vertical direction V. Transverse direction T is substantially perpendicular to horizontal and vertical directions H, V. Thus, vertical direction V, horizontal direction H, and transverse direction T are orthogonally oriented such that vertical direction V, horizontal direction H, and transverse direction T form an orthogonal directional system.

Moreover, the chamber 101 has interior walls including opposing sidewalls 118, bottom wall 119, back wall 120, and top wall 121 that define cooking chamber 116. Bottom wall 119 and top wall 121 are spaced apart along the vertical direction V, and sidewalls 118 extend along the vertical direction V between top wall 121 and bottom wall 119. Back wall 120 extends between sidewalls 118 along the horizontal direction and also extends between top wall 121 and bottom wall 119 along the vertical direction V.

Sidewalls 118 include supports 122 (FIG. 2) for supporting oven racks 132 (FIG. 2) that may be selectively positioned within chamber 116. Oven racks 132 include a top rack 136 and a bottom rack 137. Top rack 136 is positioned above bottom rack 137 along the vertical direction V.

The oven appliance 100 also includes a door assembly 150 having an outer panel 104 with handle 105 that provides for opening and closing access to a cooking chamber 116. A user of the oven appliance 100 can place a variety of different items to be cooked in chamber 116 onto racks 132. Heating elements 117 are positioned at the top and the bottom of chamber 116 to provide heat for cooking and cleaning. Such heating element(s) can be e.g., gas, electric, microwave, or a combination thereof. Other heating elements (not shown) could be located at other locations as well. A window 110 on the door assembly 150 allows the user to view e.g., food items during the cooking process.

Referring still to FIG. 1, the oven appliance 100 includes a user interface 102 having a display 103 positioned on top panel 114 with a variety of controls 112. In certain embodiments, the interface 102 allows the user to select various options for the operation of oven appliance 100 including e.g., temperature, time, and/or various cooking and cleaning cycles. Operation of the oven appliance 100 can be regulated by a controller 158 (FIG. 2) that is operatively coupled i.e., in communication with, user interface panel 102, heating element(s), and other components of oven appliance 100 as will be further described.

For example, in response to user manipulation of the user interface panel 102, the controller 158 can operate heating element(s). The controller 158 can receive measurements from a temperature sensor 113 (FIG. 2) placed in cooking chamber 116 and e.g., provide a temperature indication to the user with display 103. By way of example, the controller 158 may include a memory and one or more processing devices such as microprocessors, CPUs, or the like, such as general or special purpose microprocessors operable to execute programming instructions or micro-control code associated with operation of appliance 100. The memory may represent random access memory such as DRAM, or read only memory such as ROM or FLASH. In one exemplary embodiment, the processor executes programming instructions stored in memory. The memory may be a separate component from the processor or may be included onboard within the processor.

The controller 158 may be positioned in a variety of locations throughout appliance 100. Thus, the controller 158 may be located under or next to the user interface 102 or otherwise within top panel 114. In an exemplary embodiment, input/output ("I/O") signals are routed between the controller 158 and various operational components of appliance 100 such as heating element(s), controls 112, display 103, sensor(s), alarms, and/or other components as may be provided. In one exemplary embodiment, the user interface panel 102 may represent a general purpose I/O ("GPIO") device or functional block.

Although shown with touch type controls 112, it should be understood that controls 112 and the configuration of the oven appliance 100 shown in FIG. 1 is provided by way of example only. More specifically, user interface 102 may include various input components, such as one or more of a variety of electrical, mechanical, or electro-mechanical input devices including rotary dials, push buttons, and touch pads. The user interface 102 may include other display components, such as a digital or analog display device designed to provide operational feedback to a user. The user interface 102 may be in communication with the controller 158 via one or more signal lines or shared communication busses. Also, the oven appliance 100 is shown as a wall oven but the present invention could also be used with other appliances such as e.g., a stand-alone oven, an oven with a stove-top, and other configurations as well.

In another embodiment, the oven appliance 100 may be equipped with features for selectively generating a forced flow of heated air within the cooking chamber 116 (e.g., using a fan(s) as discussed in greater detail below). Thus, the oven appliance 100 is generally referred to as a convection oven. Such a flow of heated air can, e.g., decrease the required cooking temperature for food items, decrease the amount of time needed to cook food items, or assist in cooking food items more evenly.

Figure 3:
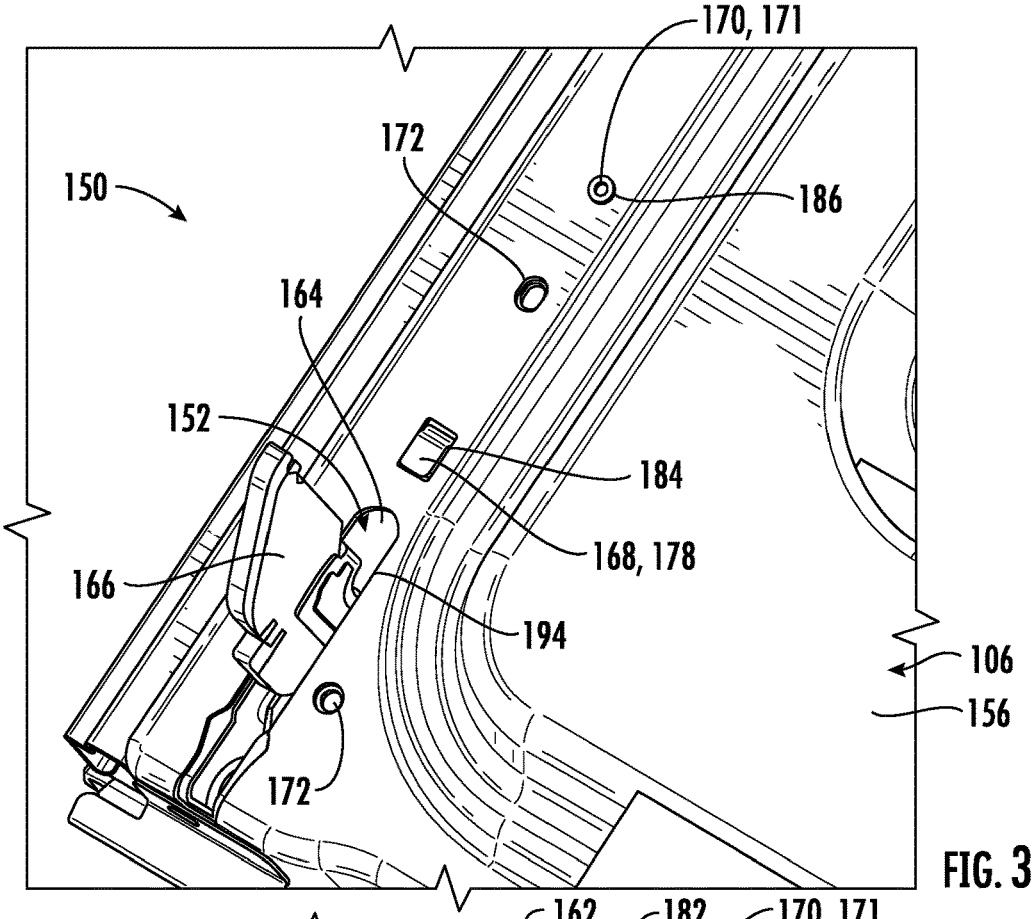
FIG. 3 provides a partial, perspective view of one embodiment of a door assembly of an oven appliance according to the present disclosure.
Figure 4:
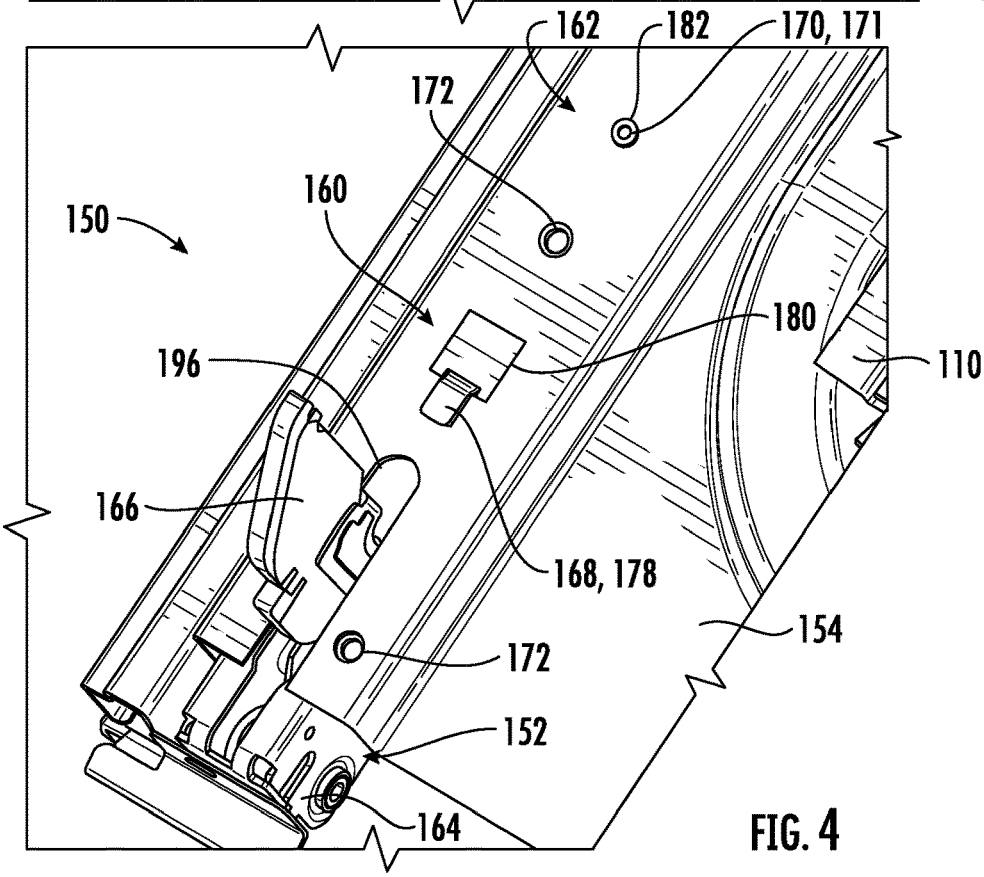
FIG. 4 provides a partial, perspective view of the door assembly of FIG. 3, particularly illustrating the inner panel removed to illustrate the hinge assembly secured to the insulative retainer panel via a locating feature(s) and a retaining feature(s).

Referring now to FIGS. 3 and 4, partial, perspective views of a door assembly 150 of the oven appliance 100 are illustrated according to the present disclosure. More particularly, FIG. 3 provides a partial, perspective view of one embodiment of the door assembly 150 of an oven appliance according to the present disclosure, which includes the outer panel 104 (FIGS. 1 and 3) and one or more inner panels arranged adjacent to the outer panel 104. For example, in certain embodiments, the inner panels may include at least one insulative retainer panel 154 (FIG. 4) arranged adjacent to the outer panel 104 and/or an inner cover panel 106 arranged adjacent to the insulative retainer panel(s) 154. Thus, FIG. 4 provides a partial, perspective view of the door assembly 150 of FIG. 3, particularly illustrating the inner panel cover 156 removed to illustrate a hinge assembly 152 secured to the insulative retainer panel(s) 154. In addition, in certain embodiments, as shown, the insulative retainer panel(s) 154 may include the window 110 secured therein.

Figure 5:
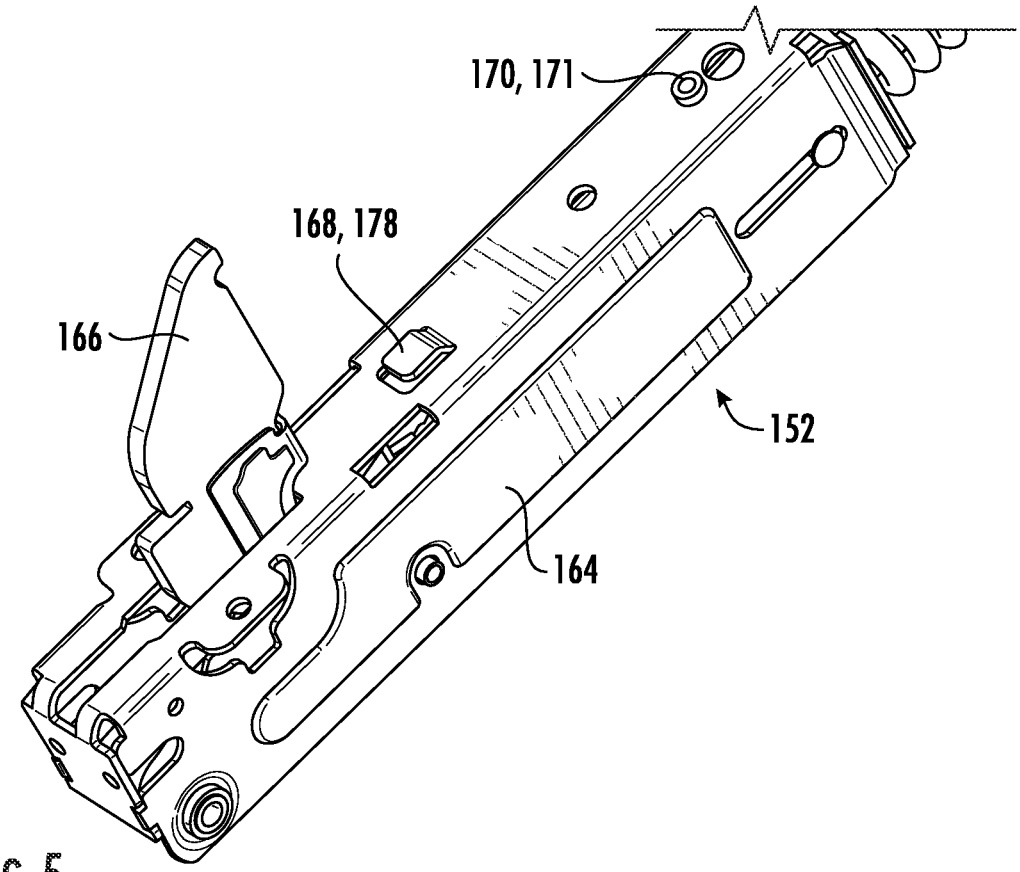
FIG. 5 provides a perspective view of one embodiment of a hinge assembly of a door assembly of an oven appliance according to the present disclosure, particularly illustrating a locating feature(s) and a retaining feature(s) thereof.

Further, as shown, the hinge assembly 152 rotatably secures the door assembly 150 to the appliance 100. Moreover, as shown in FIG. 4, the hinge assembly 152 is secured between the outer panel 104 and the insulative retainer panel(s) 154. In addition, as shown in FIGS. 3-5, the hinge assembly 152 includes a hinge body 164 and a hinge 166 extending from the hinge body 164. For example, in one embodiment, the hinge 166 may extend substantially perpendicular from the hinge body 164. Moreover, as shown, for example, the hinge body 164 defines at least one retaining feature 168 and at least one locating feature 170 formed integrally therewith. In addition, as shown, the insulative retainer panel(s) 154 and the inner panel cover 156 have first and second sets of aligned apertures 160, 162, respectively.

Accordingly, as shown in FIGS. 3 and 4, the retaining feature 168 is received within the first set 160 of aligned apertures so as to position the insulative retainer panel(s) 154 and the inner panel cover 156 in a desired configuration. Moreover, as shown, the locating feature 170 is received within the second set 162 of aligned apertures so as to retain the insulative retainer panel(s) 154 and the inner panel cover 156 in the desired configuration. In addition, as shown in FIGS. 3 and 4, the insulative retainer panel(s) 154 and the inner panel cover 156 may also include aligned recesses 194, 196 for receiving the hinge 166 therethrough. Further, as shown in FIGS. 3 and 4, the door assembly 150 includes one or more fasteners 172 for securing the inner panel cover 156, the insulative retainer panel(s) 154, and the hinge body 164 together.

In such embodiments, the retaining feature 168 and the locating feature 170 are configured to improve tolerance stack issues associating with using fasteners alone. In addition, the retaining feature 168 and the locating feature 170 are configured to improve the ergonomics of the assembly process. In particular, by adding the locating feature 170 to the hinge body 164 and the retaining feature 168 that also provides rotational control, the hinge assembly 152 provides tightly controlled sheet metal locators that also support the hinge assembly 152 during the assembly process without the need of additional fixturing.

Figure 6:
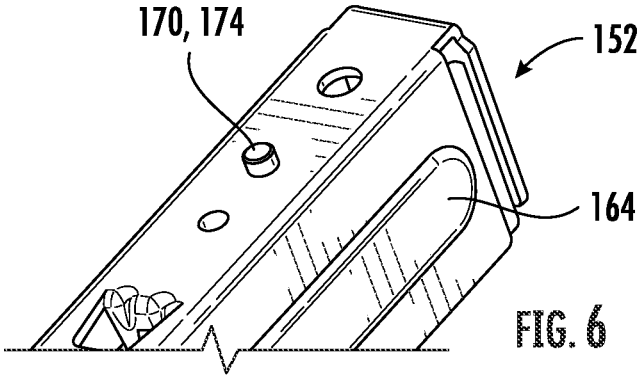
FIG. 6 provides a partial, perspective view of another embodiment of a hinge assembly of a door assembly of an oven appliance according to the present disclosure, particularly illustrating a locating feature(s) thereof.
Figure 7:
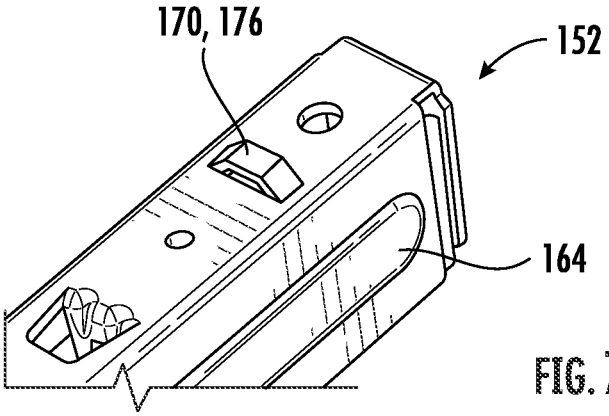
FIG. 7 provides a partial, perspective view of still another embodiment of a hinge assembly of a door assembly of an oven appliance according to the present disclosure, particularly illustrating a locating feature(s) thereof.

In particular embodiments, as shown in FIGS. 3-5, the locating feature(s) 170 may include a protrusion member 171, such as a pin or dowel. Alternatively, as shown in FIG. 6, the locating feature(s) 170 may include a shoulder rivet 174. In still another embodiment, as shown in FIG. 7, the locating feature(s) 170 may include an embossed feature 176. Referring back to FIGS. 3-5, the retaining feature(s) 168 may include, for example, a protrusion member (similar to the protrusion member 171) or a hook member 178. Accordingly, in one embodiment, the locating feature(s) 170 may include the protrusion member 171 for locating the panels 154, 156 and the retaining feature(s) 168 may include the hook member 178 so as to prevent rotation around the protrusion member 171. Alternatively, the locating feature(s) 170 and the retaining feature(s) 168 may be protrusion members 171.

Referring particularly to FIG. 4, in several embodiments, the hook member 178 may be secured to the insulative retainer panel(s) 154 through a first aperture 180 in the insulative retainer panel(s) 154 of the first set 160 of aligned apertures. Thus, as shown, the insulative retainer panel(s) 154 can be slid into place until the protrusion member 171 engages with a second aperture 182 in the insulative retainer panel(s) 154 of the second set 162 of aligned apertures so as to support the hinge assembly 152 during an assembly process of the door assembly 150. In certain embodiments, the protrusion member 171 may be secured within the second aperture 182 in the insulative retainer panel(s) 154 of the second set 162 of aligned apertures via a snap fit.

Thus, referring now to FIG. 5, in further embodiments, the inner panel cover 156 may then be secured to the hinge assembly 152 atop to the insulative retainer panel(s) 154 by aligning the protrusion member 171 and the hook member 178 with first and second apertures 184, 186 in the inner panel cover 156 of the first and second sets 160, 162 of aligned apertures, respectively. In another embodiment, sides of the hook member 178 can be used to control an angular position of the hinge body 164 in relation to the inner panel cover 156.

In yet another embodiment, as shown in FIGS. 3-5, the hinge 166, the protrusion member 171, and the hook member 178 may be aligned along a longitudinal axis of the hinge body 164.

Figure 8:
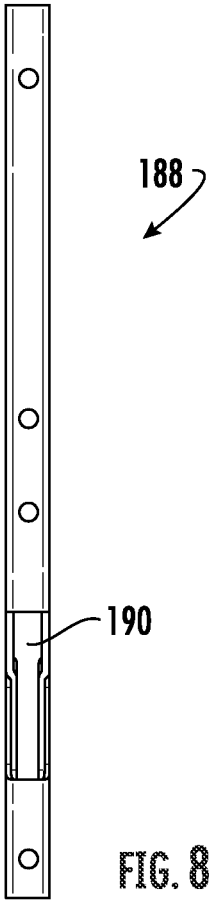
FIG. 8 provides a front view of one embodiment of a receiver of a door assembly of an oven appliance according to the present disclosure.
Figure 9:
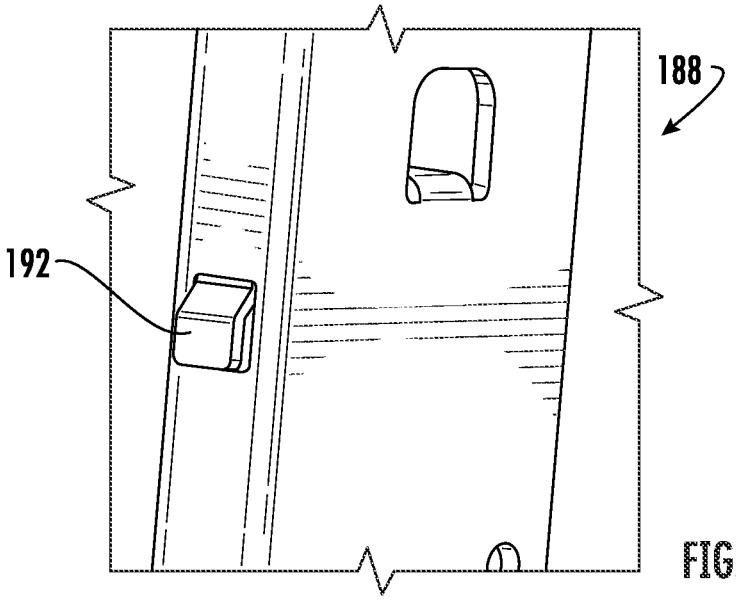
FIG. 9 provides a partial, detailed view of the receiver of FIG. 8 at an intermediate location.
Figure 10:
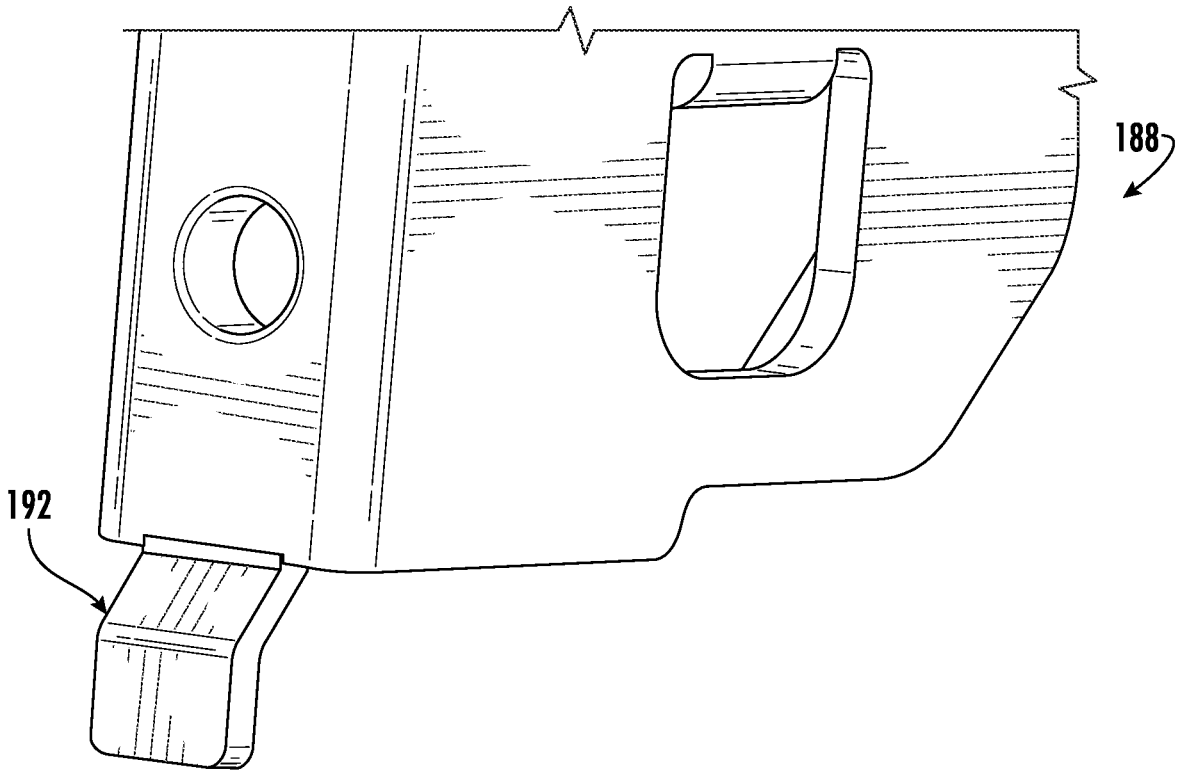
FIG. 10 provides a partial, detailed view of the receiver of FIG. 8 at a bottom location.

Referring now to FIGS. 8-10, the door assembly 150 may include a receiving member 188 for receiving the hinge 166 of the hinge assembly 152 of the door assembly 150, e.g., via slot 190. Thus, in certain embodiments, as shown in FIGS. 9 and 10, the receiving member 188 may also include at least one locating feature 192 for inserting within a mating aperture on the door assembly 150, i.e., when the hinge 166 is secured within the slot 190. In such embodiments, where the receiving member 188 includes at least two hook members 192 (as shown) to the front mounting surface and the door assembly 150 includes mating slots on the front frame, then better alignment of the receiving member 188 can be achieved along with a very effective assembly aid, thereby eliminating the need for an operator to hold the part in place with one hand while installing fasteners with the other.

Figure 11:
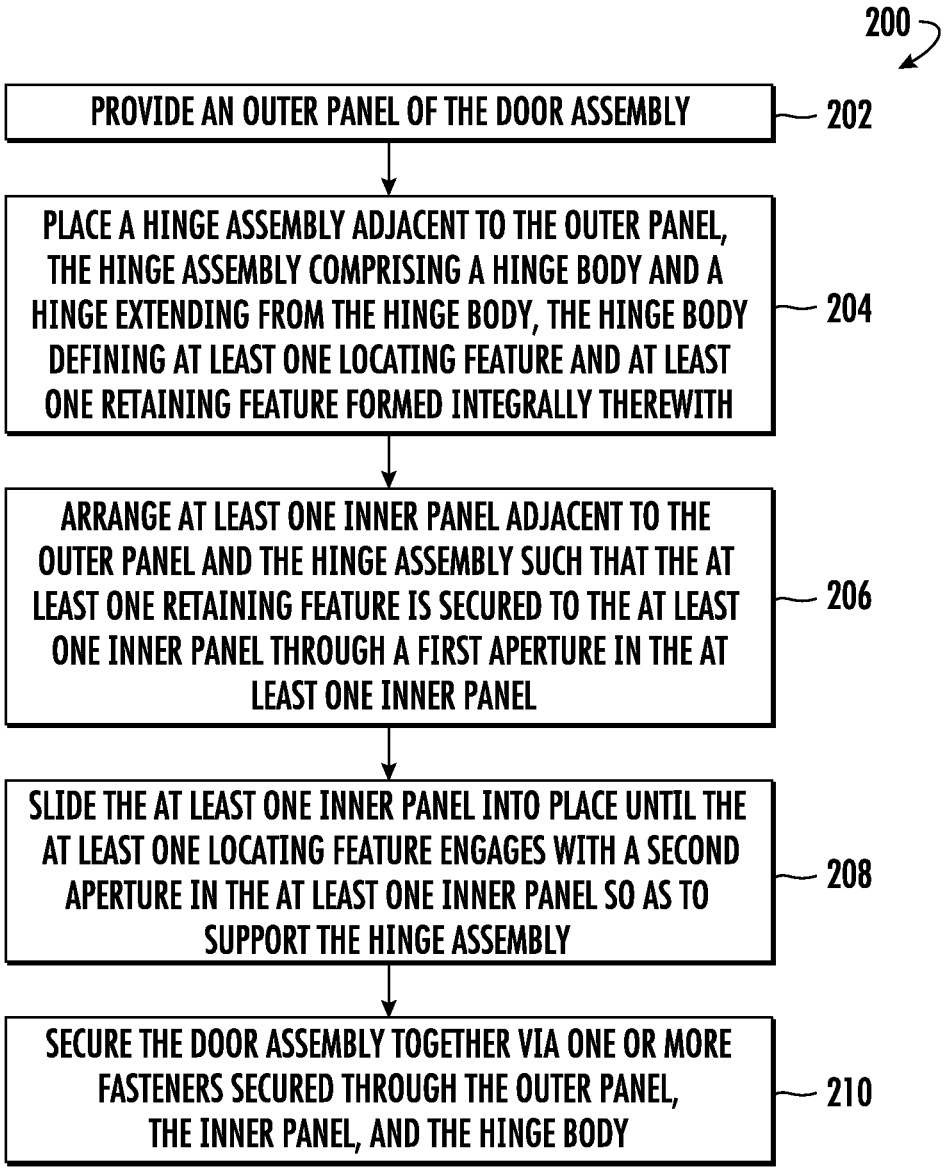
FIG. 11 provides a flow diagram of one embodiment of a method of assembling a door assembly of an oven appliance according to the present disclosure.

Referring now to FIG. 11, a flow diagram of one embodiment of the method 200 of assembling a door assembly of an oven appliance is illustrated in accordance with aspects of the present disclosure. The method 200 is described herein with respect to the door assembly 150 of the oven appliance 100 illustrated in FIGS. 1-10. However, it should be appreciated that the disclosed method 200 may be implemented using any other suitable appliance now known or later developed in the art. In addition, although FIG. 11 depicts steps performed in a particular order for purposes of illustration and discussion, the methods described herein are not limited to any order or arrangement. One skilled in the art, using the disclosures provided herein, will appreciate that various steps of the methods can be omitted, rearranged, combined and/or adapted in various ways.

As shown at (202), the method 200 includes providing an outer panel 104 of the door assembly 150. As shown at (204), the method 200 includes placing a hinge assembly 152 adjacent to the outer panel 104. As mentioned, the hinge assembly 152 includes a hinge body 164 and a hinge 166 extending from the hinge body 164. Further, as mentioned, the hinge body 164 defines at least one locating feature 160 and at least one retaining feature 168 formed integrally therewith.

Accordingly, as shown at (206), the method 200 includes arranging at least one inner panel, such as the insulative retainer panel(s) 154 and/or the inner cover panel 156, adjacent to the outer panel 104 and the hinge assembly 152 such that the retaining feature(s) 168 is secured to the inner panel(s) through a first aperture 180 in the inner panel(s). As shown at (208), the method 200 includes sliding the inner panel(s) into place until the locating feature(s) 170 engages with a second aperture 182 in the inner panel(s) so as to support the hinge assembly 152. inner panel cover 156 inner panel cover 156 inner panel cover 156 As shown at (210), the method 200 includes securing the door assembly 150 together via one or more fasteners 172 secured through the outer panel 104, the inner panel(s), and the hinge body 164.

It should be understood that the locating feature(s) 170 and the retaining feature(s) 168 may be any of the features described herein, such as the protrusion member 171 and/or the hook member 178. Thus, in an embodiment, the method 200 may include using sides of the hook member 178 to control an angular position of the hinge body 164 in relation to the inner panel cover 156.

Moreover, in an embodiment, the method 200 may include securing the hinge 166 within a receiving member 188 of the oven appliance 100 having at least one locating feature 192 for inserting within a mating aperture on the door assembly 150.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A door assembly for an appliance, the door assembly comprising:

an outer panel;

at least one inner panel arranged adjacent to the outer panel, the at least one inner panel comprising a first set of apertures, the first set of apertures comprising a first aperture and a second aperture; and a hinge assembly for rotatably securing the door assembly to the appliance, the hinge assembly secured between the outer and inner panels, the hinge assembly comprising a hinge body and a hinge extending from a first side of the hinge body, the hinge body defining at least one locating feature at a first location on an outer surface of the first side of the hinge body and at least one retaining feature at a different, second location on the outer surface of the first side of the hinge body, the hinge, the at least one locating feature, and the at least one retaining feature being aligned in a vertical direction on the first side of the hinge body, the at least one locating feature comprising a protrusion member formed integrally with and extending from the outer surface of the first side of the hinge body, the at least one retaining feature comprising a hook member formed integrally with and extending from the outer surface of the first side of the hinge body so as to prevent rotation of the hinge body around the protrusion member, the at least one locating feature received within the first aperture and extending through the at least one inner panel, the at least one retaining feature received within the second aperture and extending through the at least one inner panel, wherein the hook member is positioned in the second aperture and slid into place until the protrusion member snaps into the first aperture in the at least one inner cover panel via a snap fit to support the hinge assembly during an assembly process of the door assembly; and one or more fasteners securing the outer panel, the at least one inner panel, and the hinge body together.

2. The oven appliance of claim 1, wherein the at least one inner panel comprises at least one insulative retainer panel arranged adjacent to the outer panel and an inner cover panel arranged adjacent to the at least one insulative retainer panel, the at least one insulative retainer panel comprising the first set of apertures, the inner cover panel comprising a second set of apertures, wherein the first and second sets of apertures align with each other.

3. The oven appliance of claim 2, wherein the inner cover panel is secured to the hinge assembly atop to the at least one insulative retainer panel by aligning the at least one locating feature and the at least one retaining feature with the first and second sets of aligned apertures, respectively.

4. The oven appliance of claim 2, wherein the at least one insulative retainer panel further comprises a window secured therein.

5. The door assembly of claim 1, wherein sides of the hook member are used to control an angular position of the hinge body in relation to the at least one inner panel.

6. The door assembly of claim 1, wherein the hinge, the protrusion member, and the hook member are aligned along a longitudinal axis of the hinge body.

7. The door assembly of claim 1, further comprising a receiving member for receiving the hinge of the hinge assembly of the door assembly, the receiving member comprising at least one locating feature for inserting within a mating aperture on the door assembly.

8. The door assembly of claim 1, wherein the at least one inner panel further comprises aligned recesses for receiving the hinge therethrough.

9. The door assembly of claim 1, wherein the appliance comprises an oven appliance.

10. A method of assembling a door assembly of an oven appliance, the method comprising:

providing an outer panel of the door assembly;

placing a hinge assembly adjacent to the outer panel, the hinge assembly comprising a hinge body and a hinge extending from a first side of the hinge body, the hinge body defining at least one locating feature at a first location on an outer surface of the first side of the hinge body and at least one retaining feature at a different, second location on the outer surface of the first side of the hinge body, the at least one locating feature comprising a protrusion member formed integrally with and extending from the outer surface of the first side of the hinge body, the at least one retaining feature comprising a hook member formed integrally with and extending from the outer surface of the first side of the hinge body so as to prevent rotation of the hinge body around the protrusion member, the hinge, the at least one locating feature, and the at least one retaining feature being aligned in a vertical direction on the first side of the hinge body;

arranging at least one inner panel adjacent to the outer panel and the hinge assembly such that the at least one retaining feature is secured to the at least one inner panel by being received within a second aperture in the at least one inner panel, the at least one retaining feature extending through the at least one inner panel;

sliding the at least one inner panel into place by sliding the at least one retaining feature within the second aperture until the at least one locating feature is received within and snaps into a first aperture via a snap fit in the at least one inner panel, the at least one locating feature extending through the at least one inner panel so as to support the hinge assembly; and securing the door assembly together via one or more fasteners secured through the outer panel, the at least one inner panel, and the hinge body.

11. The method of claim 10, wherein the at least one inner panel comprises at least one insulative retainer panel and an inner cover panel, the at least one insulative retainer panel comprising the first set of apertures, the inner cover panel comprising a second set of apertures, wherein the first and second sets of apertures align with each other, the method further comprising:

arranging the inner cover panel adjacent to the at least one insulative retainer panel; and securing the inner panel to the hinge assembly adjacent to the at least one insulative retainer panel by aligning the at least one locating feature and the at least one retaining feature with first and second apertures of the second set of apertures in the inner panel, respectively.

12. The method of claim 10, further comprising using sides of the hook member to control an angular position of the hinge body in relation to the at least one inner panel.

13. The method of claim 10, further comprising securing the hinge within a receiving member of the oven appliance, the receiving member comprising at least one additional locating feature for inserting within a mating aperture on the door assembly.

* * * * *